US009210975B2

(12) United States Patent
Reese

(10) Patent No.: US 9,210,975 B2
(45) Date of Patent: Dec. 15, 2015

(54) LAPTOP SADDLEBAG

(71) Applicant: Harvey Reese, Philadelphia, PA (US)

(72) Inventor: Harvey Reese, Philadelphia, PA (US)

( * ) Notice: Subject to any disclaimer, the term of this patent is extended or adjusted under 35 U.S.C. 154(b) by 171 days.

(21) Appl. No.: 13/961,552

(22) Filed: Aug. 7, 2013

(65) Prior Publication Data

US 2015/0041271 A1 Feb. 12, 2015

(51) Int. Cl.

| | |
|---|---|
| ***A45C 5/06*** | (2006.01) |
| ***A45C 7/00*** | (2006.01) |
| ***A45C 13/02*** | (2006.01) |
| *A45C 5/03* | (2006.01) |

(52) U.S. Cl.

CPC ..... *A45C 5/06* (2013.01); *A45C 7/0045* (2013.01); *A45C 13/02* (2013.01); *A45C 2005/037* (2013.01); *A45C 2013/025* (2013.01)

(58) Field of Classification Search

CPC ..... A45C 7/0022; A45C 5/14; A45C 7/0063; A45C 7/0031; A45C 7/0027; B60R 7/043; B60R 7/14; B60R 7/04; B60N 3/103; B60N 3/08

USPC ..... 190/103, 100, 18 A, 111, 110, 108, 107, 190/102; 224/682, 660, 655, 584, 578, 576, 224/575, 153; 206/583, 579, 523, 320

See application file for complete search history.

(56) References Cited

U.S. PATENT DOCUMENTS

| | | | | | |
|---|---|---|---|---|---|
| 3,122,225 | A | * | 2/1964 | Ward | 190/108 |
| D236,556 | S | * | 8/1975 | paola | D3/299 |
| 4,817,802 | A | * | 4/1989 | Pratt | 206/579 |
| 5,062,557 | A | * | 11/1991 | Mahvi et al. | 224/153 |
| 5,217,119 | A | * | 6/1993 | Hollingsworth | 206/583 |
| 5,265,719 | A | * | 11/1993 | Wand | 206/223 |
| 5,494,157 | A | * | 2/1996 | Golenz et al. | 206/320 |
| 5,971,148 | A | * | 10/1999 | Jackson | 206/320 |
| 6,131,734 | A | * | 10/2000 | Hollingsworth et al. | 206/320 |
| 6,994,194 | B2 | * | 2/2006 | Smith | 190/111 |
| 7,293,649 | B2 | * | 11/2007 | Gelphman et al. | 206/320 |
| D673,362 | S | * | 1/2013 | Presman et al. | D3/217 |
| 8,567,578 | B2 | * | 10/2013 | Cuong et al. | 190/107 |

* cited by examiner

*Primary Examiner* — Anthony Stashick
*Assistant Examiner* — Cynthia Collado
(74) *Attorney, Agent, or Firm* — Michael J. Foycik, Jr.

(57) ABSTRACT

A person conveying a laptop computer will frequently need to use this computer in less that ideal circumstances. A saddlebag, unlike ordinary laptop carry cases, functions as a multipurpose tool as well as a safe conveyance so the person carrying it can be more productive in less than ideal circumstances. It's a sleeve, not a bag, allowing for instant laptop access from either side. The inner sides of the sleeve are padded, but each side can unsnap to pull out independently—one functioning as a lap desk and the other as a white board. A briefcase is attached to one side of the saddlebag and two gadget bags to the other side, any of which can unsnap for independent use. It includes a series of quickly accessible pockets to hold the small tools and devices that one would ordinarily keep on his/her regular desk.

4 Claims, 8 Drawing Sheets

LAPTOP SADDLEBAG

CROSS REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates to combination carrying cases, briefcases, and portable stowing devices in general.

BACKGROUND OF THE INVENTION

It is a problem in the art to provide a combination carrying case for carrying portable items, with and without including a laptop computer.

Briefcases are well known, as are portable carrying devices such as purses and backpacks. Additionally, laptop cases are known for carrying laptop computers. Such laptop cases can include a simple cover, a padded covering with or without a handle, and can also include a hard shell container.

However, all such known devices are limited such that they cannot conveniently carry more than just a laptop computer. For example, a laptop case having a side compartment is unbalanced, and the side compartments would necessarily be the same size or smaller than the laptop case itself. Additionally, such laptop cases normally do not stand on their own.

There is a need in the art for a convenient way to carry a variety of portable items, with and without a laptop computer, that is balanced and can stand upright when placed on a surface.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a convenient way to carry a variety of portable items, with and without a laptop computer, that is balanced and can stand upright when placed on a surface.

More specifically, the laptop saddlebag of the present invention includes a hollow casing with open ends for receiving a laptop computer, an expandable briefcase mounted on one side of the hollow casing, gadget bags mounted on the other side of the hollow casing, a handle, and tabs for shoulder straps.

A person conveying a laptop computer will frequently need to use this computer in less that ideal circumstances. A saddlebag, unlike ordinary laptop carry cases, functions as a multipurpose tool as well as a safe conveyance so the person carrying it can be more productive in less than ideal circumstances. It's a sleeve, not a bag, allowing for instant laptop access from either side. The inner sides of the sleeve are padded, but each side can unsnap to pull out independently—one functioning as a lap desk and the other as a white board. A briefcase is attached to one side of the saddlebag and two gadget bags to the other side, any of which can unsnap for independent use. It includes a series of quickly accessible pockets to hold the small tools and devices that one would ordinarily keep on his/her regular desk.

The hollow casing of the laptop saddlebag of the present invention is relatively balanced, and has retaining straps at either end to retain a laptop computer therein. The laptop saddlebag can be used without a laptop computer inside. The hollow casing has a relatively hard lower wall such that it can support the laptop saddlebag in an upright position (i.e., stand) on a level surface.

Other objects and advantages of the present invention will be more readily apparent from the following detailed description when read in conjunction with the accompanying drawings.

DETAILED DESCRIPTION OF THE INVENTION

A person conveying a laptop computer from one location to another will frequently need to use this computer in less that ideal circumstances, away from his/her home base, and so the saddlebag 100 (FIG. 1), unlike ordinary laptop carry cases, functions as a multipurpose tool as well as a safe conveyance in order to make the person carrying it be more productive in less than ideal circumstances.

Advantages and Features of the Laptop Saddlebag

It's a sleeve, not a bag, allowing for instant laptop access from either side.

The inner sides of the sleeve are padded to protect the computer, but each side can unsnap to pull out independently—one then functioning as a lap desk and the other as a white board.

A briefcase is attached to one side of the saddlebag 100 and two gadget bags to the other side—any of which can unsnap for independent use.

The Saddlebag 100 is designed with a series of quickly accessible pockets to hold the small tools and devices that one would ordinarily keep on his/her regular desk.

In other words—the laptop saddlebag is a needed invention which is a safe, convenient laptop carrier that is also a multi-tasking tool designed to increase the efficiency of a traveling individual using it in makeshift conditions.

Figure 1:
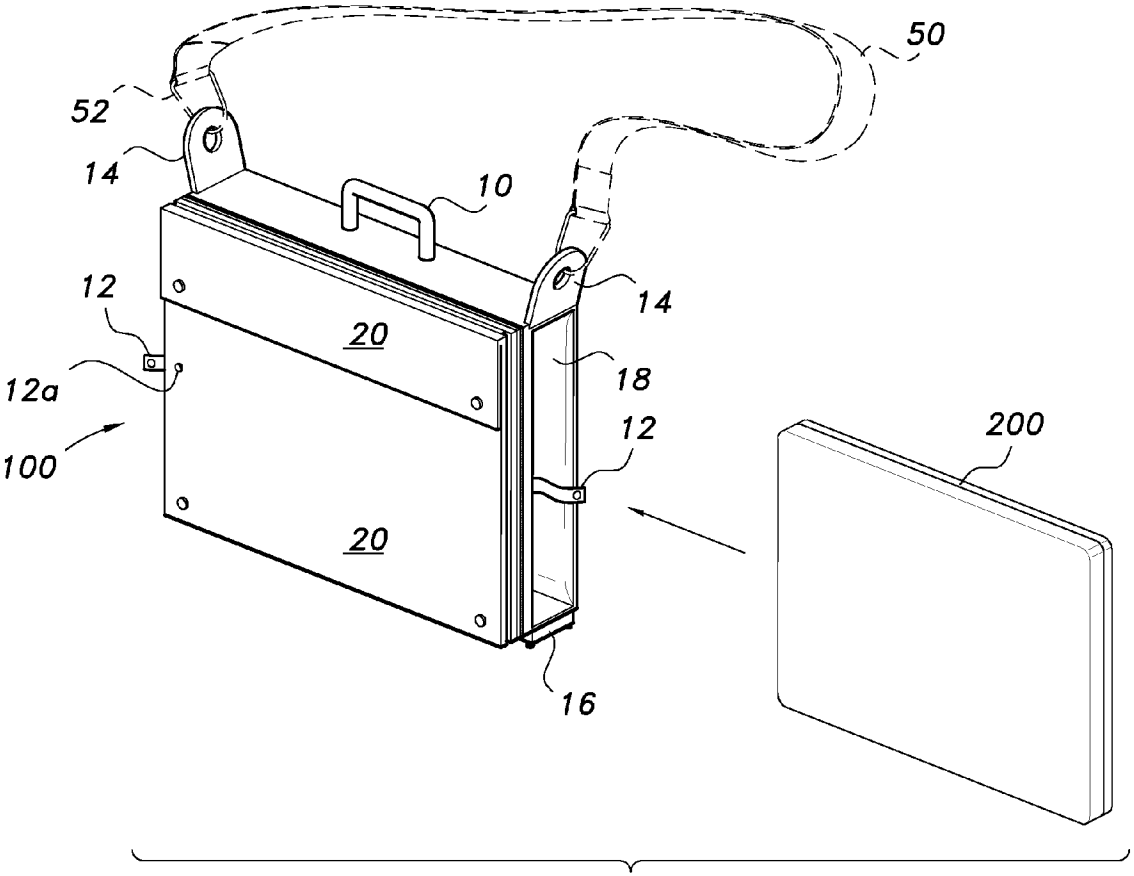
FIG. 1 is a perspective view of a laptop saddlebag according to the present invention, schematically indicating insertion of a laptop computer therein.
Figure 9:
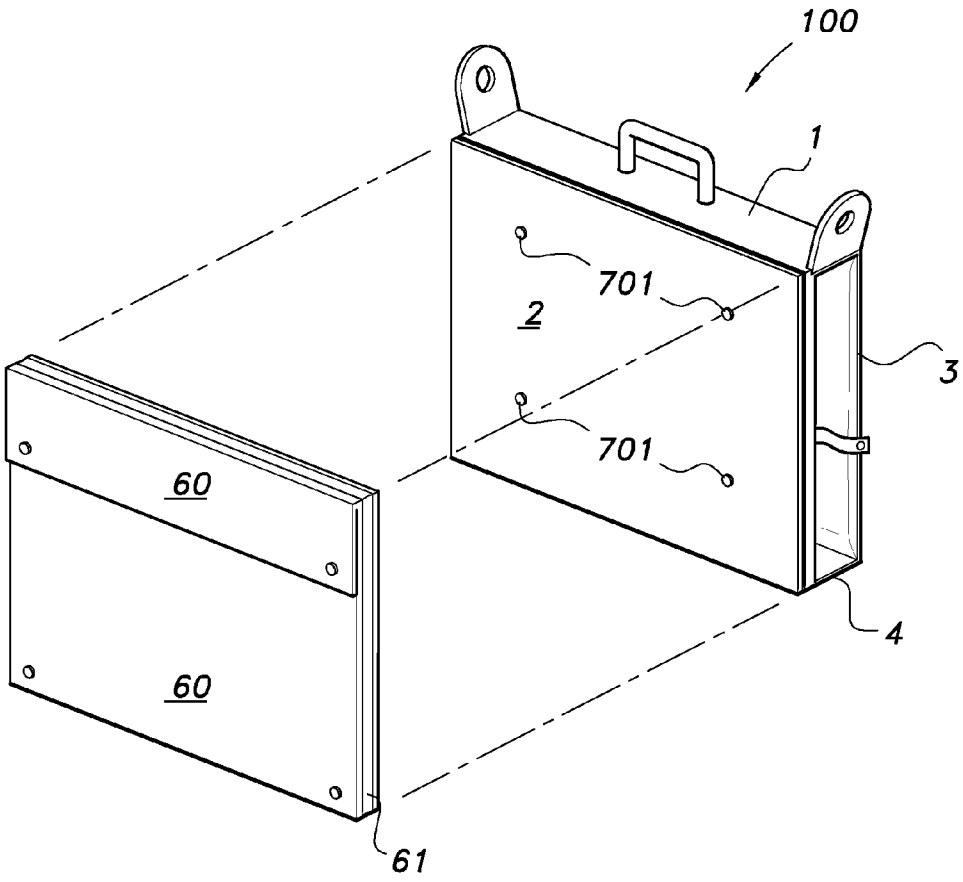
FIG. 9 is a schematic exploded view of the laptop saddlebag of FIG. 1, showing the expandable briefcase mounted to a first upstanding wall by a snap-on feature.

FIG. 1 is a perspective view of a laptop saddlebag 100, schematically indicating insertion of a laptop computer 200 therein. FIG. 9 shows the elements of FIG. 1 in an assembly view, and reference is made to this figure too when describing the elements of FIG. 1. The laptop saddlebag 100 has a top wall 1, a first upstanding side wall 2, a second upstanding side wall 3, and a bottom wall 4, wherein elements 1-4 are depicted in FIG. 9 for the sake of clarity. An interior cavity 18 is bounded by the walls 1-4, and together the walls 1-4 formed a hollow casing having the interior cavity 18 therein.

The hollow cavity 18 forms a laptop sleeve, allowing slide-in insertion of the laptop computer 200. A handle 10 is mounted on the top wall 1, and allows a user to carry the laptop saddlebag 100 with one hand.

The laptop saddlebag 100 includes a pair of closure straps 12, a pair of fastener elements 12*a* (only one of which is visible in FIG. 1), an expandable briefcase 20, a footed base 16, a pair of shoulder strap tabs 14 for connection to a should strap 50 (shown in dashed outline in FIG. 1). The shoulder strap 50 has a pair of connecting links 52, 52 disposed at opposite ends thereof for connection to any of the tabs shown in FIGS. 1-9.

Figure 7:
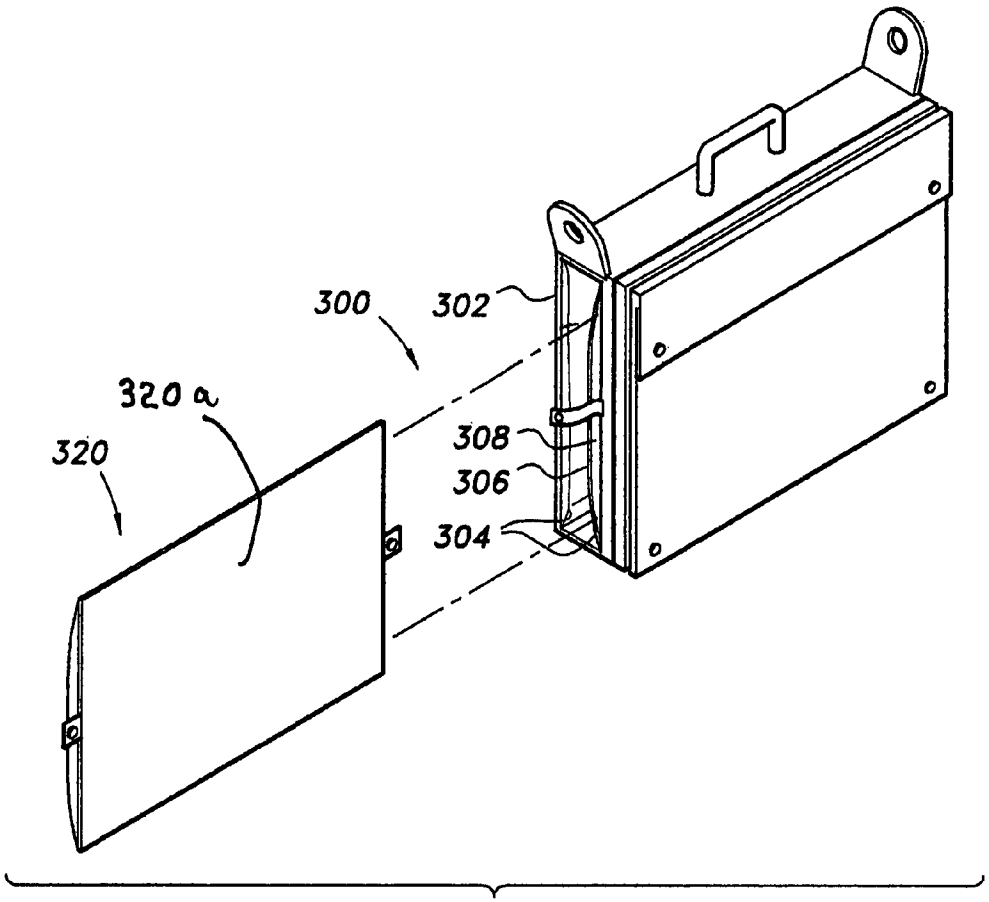
FIG. 7 is an assembly view in perspective of the laptop saddlebag seen from the left of FIG. 1, showing an interior construction together with an insertable/removable lap desk which also serves as padding.

The footed base 16 is preferably a neoprene base and has feet, which can be of any conventional variety. Also, each of the straps 12 is fixed at one end and has a securing means at its free end such as a snap fastener, hook-and-loop fastener material, lacing, button(s), or any other securing means which would be within the ambit of skill of any one having skill in the fastening arts. The expandable briefcase 20 can be a simple accordion type with a top flap, or can be a completely openable type closed by a zipper (shown in FIG. 4). The interior wall surfaces bounding the cavity 18 can be padded (as shown in FIG. 7) or left bare.

The laptop saddlebag 100 according to the present invention provides a convenient way to carry a variety of portable items, with and without a laptop computer, that is balanced and can stand upright when placed on a surface. The laptop computer 200 is shown, but is not part of the laptop saddlebag 100. In use, the cavity 18 can be left empty and the laptop saddlebag 100 will still be useful.

The hollow casing—formed by the above-described walls 1, 2, 3, and 4—of the laptop saddlebag 100, together with the expandable briefcase 20 and the gadget bags 30 (shown in FIG. 3), serves to provide a relatively balanced article either alone or with a laptop computer 200 inside. This means that the laptop saddlebag 100 can be lifted and carried by its handle 10 with relative ease compared with a typically unbalanced group of separate articles a user might otherwise carry such as a briefcase, laptop case, gadget bag or bookbag, and so on. As noted above, the laptop saddlebag 100 can be used without a laptop computer 200 inside, and will still allow relatively good balance when a user carries it by its handle 10 or by its shoulder strap 50. The relatively hard lower wall 16 is such that it can support the laptop saddlebag 100 in an upright position (i.e., stand) on a level surface.

Figure 2:
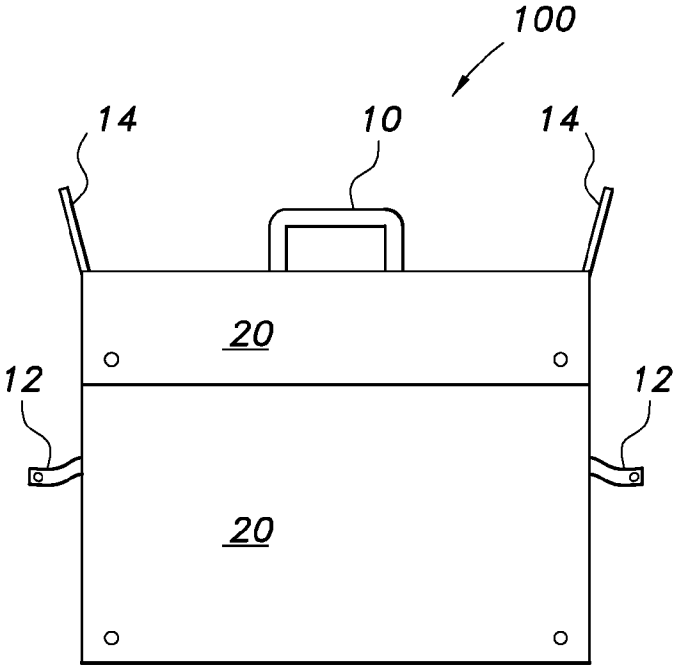
FIG. 2 is a front elevational view of the laptop saddlebag of FIG. 1, showing an expandable briefcase.

FIG. 2 is a front elevational view of the laptop saddlebag 100 of FIG. 1, showing an expandable briefcase 20. As shown in FIG. 9, the expandable briefcase 20 is mounted by a snap-on feature so that it is selectively removable by a user. Other types of mounting arrangements within the ambit of any one having skill in the fastening arts are also contemplated as being within the scope of the present invention.

Figure 3:
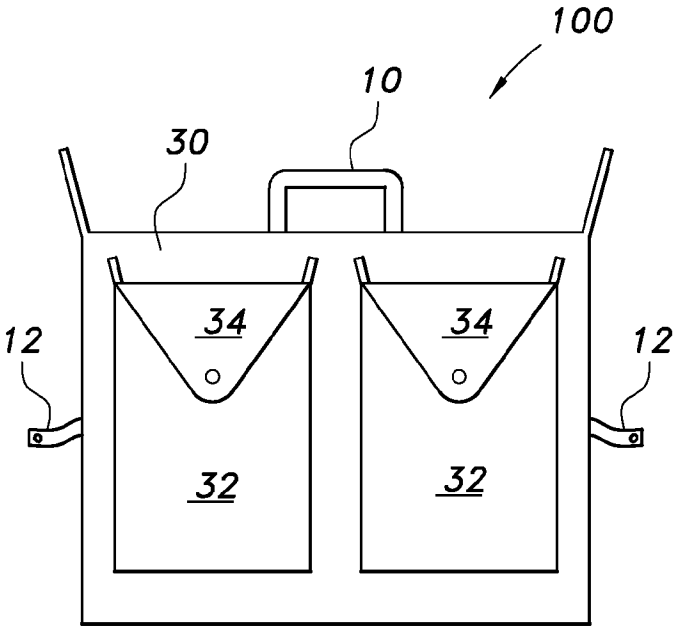
FIG. 3 is a rear elevational view of the laptop saddlebag of FIG. 1, showing gadget bags.

FIG. 3 is a rear elevational view of the laptop saddlebag of FIG. 1, showing a surface 30 of the wall 3 carrying a plurality of gadget bags 32, 32. Each of the gadget bags 32 respectively includes a snap-closed flap 34 thereon, which closed the gadget bags 32 to prevent contents from spilling out. In addition, each of the gadget bags 32 may itself have a pair of tabs (not numbered in FIG. 3), and which may be formed as simple tabs with slots therein, or open links, loops, snaps, and so on, for securement to a strap (not shown). Each of the gadget bags 32 is preferably mounted by a snap-on feature (similar to that shown in FIG. 9 for the expandable briefcase 20) so that it is selectively removable by a user. Other types of mounting arrangements within the ambit of any one having skill in the fastening arts are also contemplated as being within the scope of the present invention.

Figure 4:
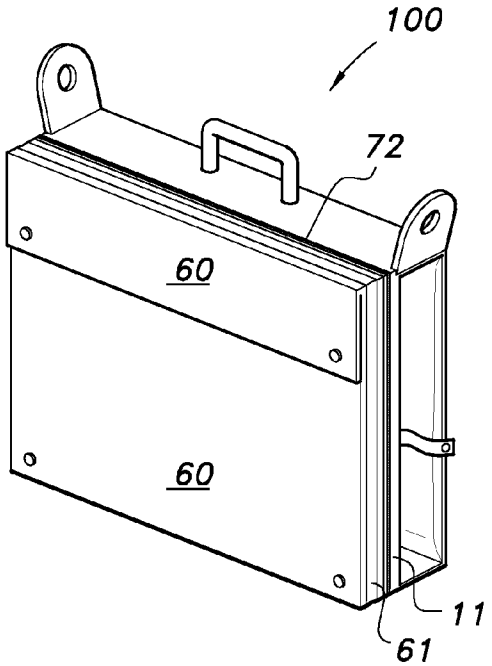
FIG. 4 is a perspective view of the laptop saddlebag of FIG. 1, showing details of the expandable briefcase of FIGS. 1 and 2.

FIG. 4 is a perspective view of the laptop saddlebag 100 of FIG. 1, showing details of an expandable briefcase 60 which is similar to the expandable briefcase 20 of FIGS. 1 and 2. As shown in FIG. 4, the briefcase 60 has a sidewall portion 61 and a zipper 72. An edge 11 of the wall 1 is shown in this view.

Figure 5:
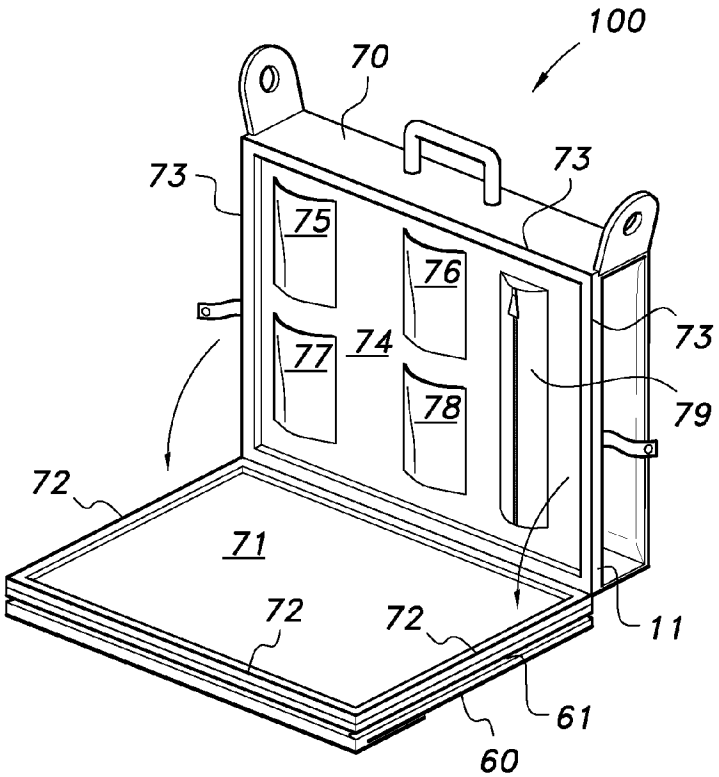
FIG. 5 is a schematic perspective view of the expandable briefcase of FIGS. 1, 2, and 4 in an opened condition, with its interior visible.

FIG. 5 is a schematic perspective view of the expandable briefcase 100 of FIGS. 1, 2, and 4 in an opened condition, with its interior visible. As seen in FIG. 5, the briefcase 60 has a front wall 71, a rear wall 74, the above-noted zipper 72, the above-noted side wall 61, and a side wall 73. The zipper 72 is used to selectively join the side wall 61 with the side wall 73 to form a closed condition of the briefcase 60; the zipper 72 in FIG. 5 shows the briefcase in its open condition with the zipper 72 unzipped.

A plurality of pockets 75, 76, 77, and 78 are shown in FIG. 5 disposed on the wall 74 of the briefcase 60. Additional pockets and features can be provided, or pockets omitted, within the scope of the present invention. The pockets can be snap-mounted on the wall 74 in the manner mentioned hereunder with reference to the snap-on elements 701 shown in FIG. 9 for connecting the briefcase 60 to the wall 2

Figure 6:
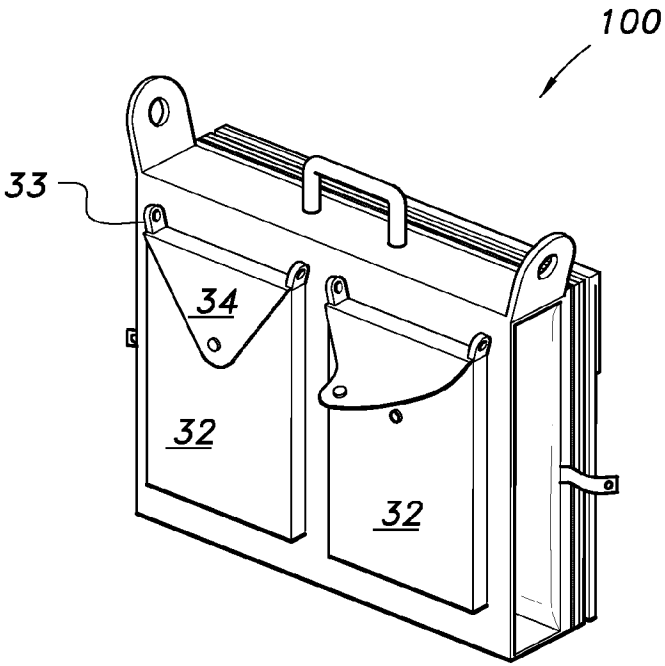
FIG. 6 is a perspective view from the rear of FIG. 1, schematically showing the gadget bags.

FIG. 6 is a perspective view from the rear of FIG. 1, schematically showing the gadget bags 32, 32 which are mounted on the wall 3 of FIG. 1, the outer surface of the wall 3 being indicated by numeral 30 in this figure. As shown in FIG. 6, each of the gadget bags 32 has a flap 34 to retain any contents therein. As shown in FIG. 6, each of the gadget bags 32 has a pair of tabs 33, for connection with the link elements 52 of the shoulder strap 50.

FIG. 7 is an assembly view in perspective of the laptop saddlebag 100 seen from the left of FIG. 1, showing an interior construction together with an insertable/removable lap desk 320 which also serves as padding when in an inserted position. In this view, the interior cavity 18 of the laptop saddlebag 100 has pad members 304, 304. An edge 302 of the cavity 18 is shown in this view. One of the pad members 304 is shown having an outer sleeve portion 306, defining an interior space 308 which receives the lap desk 320 when the lap desk 320 is in an inserted position. The insertable/removable lap desk 320 preferably has a typical lap desk construction, including a relatively soft side for resting on a lap as well as a relatively hard side for supporting articles such as paper, cell phones, touchpad computer, or a notebook computer, for example.

In the embodiment of FIG. 7, the other of the two pads 304 could likewise form a sleeve and contain an article. In one alternative embodiment, that other one of the two pads 304 could have a whiteboard inside for use in erasable writing. Other articles could likewise be used, if they can fit into the sleeve and do not cause damage to a computer when inserted in the cavity 18 as shown in FIG. 1.

As seen in FIG. 7, the insertable/removable lap desk 320 has a whiteboard writing surface 320*a*. The whiteboard writing surface is removable along with the insertable/removable lap desk 320, and therefore constitutes a removable whiteboard writing surface.

Figure 8:
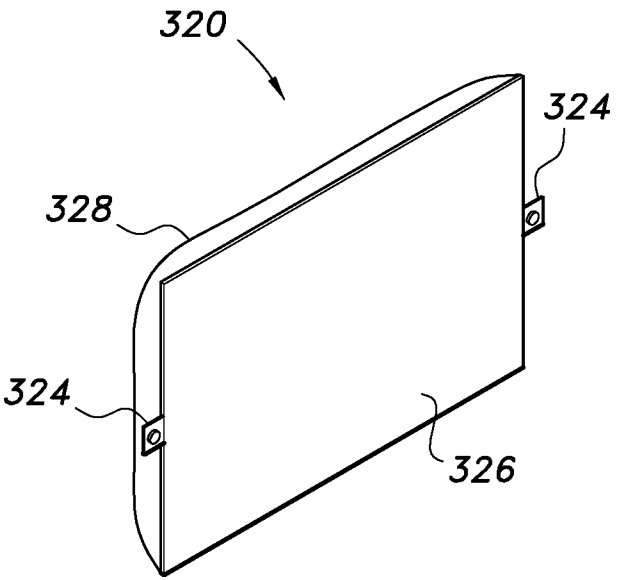
FIG. 8 is a perspective view of the insertable/removable lap desk of FIG. 8.

FIG. 8 is a perspective view of the insertable/removable lap desk of FIG. 8.

FIG. 9 is a schematic exploded view of the laptop saddlebag 100 of FIG. 1, showing the expandable briefcase mounted to a first upstanding wall by a snap-on feature 701. In FIG. 9 there is shown a plurality of snap-on fastener members 701, schematically depicted. As shown in FIG. 9, the expandable briefcase 20 is mounted by the snap-on feature so that the briefcase 20 is selectively removable by a user. Other types of mounting arrangements within the ambit of any one having skill in the fastening arts are also contemplated as being within the scope of the present invention.

Figure 10:
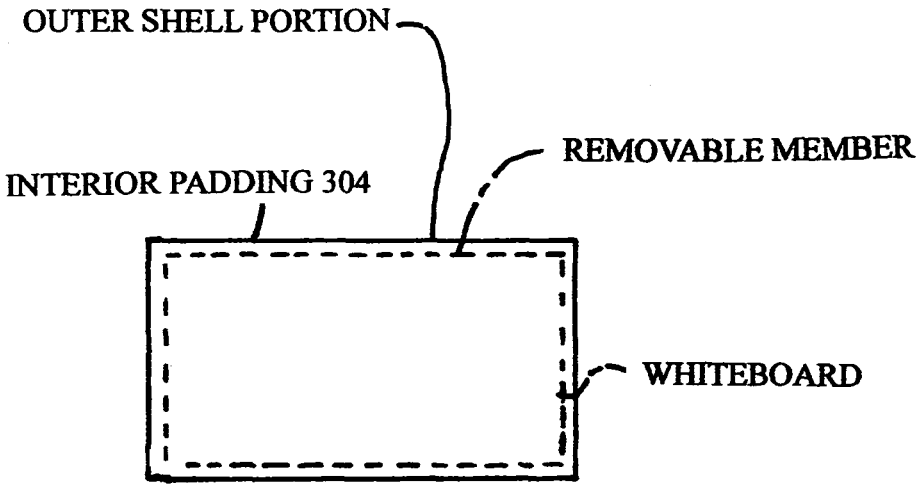
FIG. 10 is a schematic view of an outer shell portion having a removable member, in which the outer shell portion is an interior padding and the removable member is a whiteboard perspective view of the expandable briefcase of FIGS. 1, 2, and 4 in an opened condition, with its interior visible.

FIG. 10 is a schematic view of an outer shell portion having a removable member, in which the outer shell portion is an interior padding 304 and the removable member is a whiteboard.

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed is:

1. A laptop saddlebag, comprising:

a hollow casing having an interior cavity, a relatively rigid bottom wall, first and second upstanding side walls, a top wall, and at least one open end in communication with said cavity for receiving a laptop computer;

an expandable briefcase mounted on the first upstanding side wall of said hollow casing;

at least one gadget bag mounted on the second upstanding side wall of said hollow casing; and further comprising interior padding on said first upstanding side wall, for cushioning a laptop computer disposed inside said cavity; and wherein said interior padding on said first upstanding side wall includes an outer shell portion and a removable interior member; wherein said removable interior member comprises a lap desk.

2. A laptop saddlebag as claimed in claim 1, further comprising a handle mounted on said top wall of said hollow casing.

3. A laptop saddlebag as claimed in claim 1, further comprising a pair of shoulder strap tabs mounted on opposite ends of said top wall of said hollow casing, and further comprising a shoulder strap secured to said top wall of said hollow casing by said pair of should strap tabs.

4. A laptop saddlebag comprising:

a hollow casing having an interior cavity, a relatively rigid bottom wall, first and second upstanding side walls, a top wall, and at least one open end in communication with said cavity for receiving a laptop computer;

an expandable briefcase mounted on the first upstanding side wall of said hollow casing; and at least one gadget bag mounted on the second upstanding side wall of said hollow casing;

further comprising interior padding on said second upstanding side said wall, for cushioning a laptop computer disposed inside said cavity;

wherein said interior padding on said second upstanding wall includes an outer shell portion and a removable object; and wherein said removable object is a white board writing surface.

* * * * *